United States Patent [19]

Provost

[11] 4,144,023

[45] Mar. 13, 1979

[54] DYEING OF HIGH STRENGTH, HIGH MODULES AROMATIC POLYAMIDE FIBERS

[75] Inventor: Richard L. Provost, Midlothian, Va.

[73] Assignee: E. I. Du Pont de Nemours and Company, Wilmington, Del.

[21] Appl. No.: 843,079

[22] Filed: Oct. 11, 1977

[51] Int. Cl.[2] ..... D06P 3/24

[52] U.S. Cl. ..... 8/17; 8/178 A; 28/266; 264/78; 264/168; 264/184

[58] Field of Search ..... 8/17, 178 A; 264/184; 28/266

[56] References Cited

U.S. PATENT DOCUMENTS

| | | | |
|---|---|---|---|
| 3,674,420 | 7/1972 | Sapers | 8/173 |
| 3,767,756 | 10/1973 | Blades | 264/184 |
| 3,869,429 | 3/1975 | Blades | 260/78.5 |
| 3,869,430 | 3/1975 | Blades | 264/184 |
| 3,888,821 | 6/1975 | Milford | 264/184 |
| 4,016,236 | 4/1977 | Nagasawa et al. | 264/184 |

FOREIGN PATENT DOCUMENTS

| | | |
|---|---|---|
| 83552 | 7/1975 | Japan. |
| 1000407 | 8/1965 | United Kingdom. |
| 1438067 | 6/1976 | United Kingdom. |

*Primary Examiner*—A. Lionel Clingman

[57] ABSTRACT

High strength, high modulus aromatic polyamide fibers are dyed by crimping the fibers while wet to at least 10 crimps per inch and maintaining at least 15% by weight moisture based on the dry fibers in the fibers at all times before dyeing.

6 Claims, No Drawings

DYEING OF HIGH STRENGTH, HIGH MODULES AROMATIC POLYAMIDE FIBERS

This invention provides an improved process for dyeing aromatic polyamide (aramid) fibers.

High strength, high modulus fibers of aromatic polyamides have recently become known from U.S. Pat. No. 3,869,429. These fibers have excellent properties but have been found to be extremely difficult to dye.

Crimped fibers of this type have been found to be dyeable with cationic dyes when a dye carrier such as acetophenone is used. However, the additional cost of the dye carrier and environmental problems associated with its use provides a need for a lower cost, safer dyeing procedure.

Poly (p-phenylene terephthalamide) (PPD-T) fibers are readily crimped by passing the dry tow (i.e. containing about 7% by weight moisture based on the dry fiber) through a steaming tube (sparger) into a steam stuffer-box crimper of the general type described in U.S. Pat. No. 2,747,233. The resulting crimped fibers containing about 8–10% by weight moisture can be dyed with cationic dyes using acetophenone as a carrier. Samples having less than 8 crimps per inch (3.1 crimps per cm.) show heavy dye concentration at the crimp nodes and a very light dye concentration between nodes giving an overall light shade of dye. The dyeability and dye uniformity increase as the crimp frequency increases. However, at crimp levels of 10 crimps per inch, dyeing is unsatisfactory in the absence of a carrier.

SUMMARY OF THE INVENTION

This invention provides an improved process for dyeing high strength, high modulus aromatic polyamide fibers comprising the steps of (1) crimping the fibers while wet to at least 10 crimps per inch (3.9/cm.), (2) maintaining the crimped fibers so that they contain at least 15% by weight moisture based on the dried fibers at all times before dyeing and (3) dyeing the fibers. Preferably the crimped fibers are dyed with cationic dyes. Preferably the starting fibers are wetted to contain at least 15% by weight moisture, (based on the dried fibers), before crimping. Preferably additional water is added to the crimped fibers so as to maintain at least 30% by weight moisture in the crimped fibers at all times before dyeing. Preferably the fibers are crimped to at least 12 crimps per inch. Preferably the crimping is done in a steam stuffer-box crimper. Dyeing under pressure is preferred.

DETAILED DESCRIPTION OF THE INVENTION

The present invention is applicable to high strength, high modulus aromatic polyamide fibers such as those produced by the process of U.S. Pat. No. 3,767,756. These fibers typically have a tenacity of at least 18 gpd., a breaking elongation of at least 3.5% and an initial modulus of at least 400 gpd. Poly(p-phenylene terephthalamide) (PPD-T) fibers are preferred.

The starting fibers need not be wetted before crimping but preferably are wetted to contain at least about 15% by weight moisture based on the dry fibers before crimping. This may be accomplished by passage of the fibers through a water bath but preferrably the fibers are flooded with water and stored in a sealed container before crimping.

The water-treated fiber should be crimped to at least 10 crimps per inch (3.9/cm.) and preferably to at least 12 crimps per inch (4.7/cm.). A finish can be applied to the fibers during crimping using a crimper similar to that shown in U.S. Pat. No. 3,160,941.

The crimped fibers should contain at least about 15% by weight moisture based on the dry fibers at all times before dyeing. This is conveniently accomplished by piddling the crimped fibers into containers which are sealed until dyed. Under most circumstances, it is advantageous to add additional water to the freshly crimped fibers in order to maintain a high level of moisture in the fibers prior to dyeing. Preferably the crimped fibers contain at least 30% by weight moisture based on the dry fibers at all times before dyeing.

In the examples, the dyeing is illustrated with batch, pressure dyeing using cationic dyes. Other dyes and dyeing processes are also suitable. For example, the crimped fibers may be dyed with cationic dyes using a pad dyeing procedure with atmospheric steaming with or without a small amount of carrier. Disperse or acid dyes may also be used but cationic dyes are preferred.

The fibers are best handled as a tow having a denier of 10,000 to 1,000,000 or more.

The preferred high strength, high modulus fibers for use in the present invention are poly(p-phenylene terephthalamide) fibers prepared by the process described in U.S. Pat. No. 3,767,756. Other high strength, high modulus fibers prepared by the process of U.S. Pat. No. 3,767,756 may also be used. These fibers are prepared from aromatic polyamides containing divalent aromatic radicals in which the chain extending bonds of the radicals are substantially coaxial or parallel and oppositely directed and are connected by amide (—NHCO—) linkages. The radicals may also be linked by vinylene, ethynylene, azo or azoxy radicals. A portion of the aromatic radicals may be replaced with trans-1,4-cyclohexylene radicals.

Apparent Dye Depth (K/S)

K/S is a measure of apparent dye depth (visual color intensity) calculated from the equation:

$$K/S = (100-R)^2/200R$$

where R is the percent light (of wave length corresponding to that of maximum absorption) reflected from the sample. In practice, R is measured on a carded pad of staple fibers weighing 2.5–3 grams in a "Colormaster Model V Differential Reflectometer" (manufactured by MEECO Instruments, Warrington, Pa.) modified to permit rotation of the sample during the reading using an appropriate filter. The depth of color of the dyed fiber is approximately proportional to the K/S value, i.e., the larger the K/S value is, the deeper the shade of the fiber. A difference of 10% in K/S values is easily seen as a shade difference between fibers.

EXAMPLE 1

A tow of continuous poly(p-phenylene terephthalamide) filaments (1.5 denier/filament, tenacity/elongation initial modulus = 24 gpd./4.3%/540 gpd.) obtained according to the process of U.S. Pat. No. 3,767,756, containing 7% moisture is passed through a 21° C. water bath and then into the sparger (steaming tube) of a steam stuffer-box crimper of the general type shown in U.S. Pat. No. 2,747,233 and crimped to give 12 crimps per inch (4.7/cm.). The crimped fibers are stored in sealed plastic bags and then scoured with aqueous detergent for 30 minutes at 82° C., drained, and rinsed with hot water. The wet fibers are dyed at 121° C. under pressure for two hours in a 15/1 dyebath prepared from 4.4% by weight of Colour Index Basic Green 6 ("Astrazon" olive green BL-200) and 0.6% by weight Colour Index Basic Orange 22 (Colour Index No. 48046 ("Astrazon" Orange R) (both based on the dry fiber weight). The dyes are pasted in water containing a small amount of glacial acetic acid, and the pH is adjusted to 2.0 to 2.5 with formic acid. The bath is cooled, the fibers are rinsed with hot water and scoured 30 minutes at 82° C., rinsed and dried. The dyed samples are cut to 3.8 cm. staple, carded into pads and K/S values determined.

EXAMPLE 2

Example 1 is repeated except additionally the crimped tow is sprayed with water as it leaves the crimper.

EXAMPLE 3

Example 2 is repeated except the starting tow is flooded with water and piddled into a container and left in the sealed container for at least 6 hours before crimping.

EXAMPLE 4

Example 1 is repeated except that the tow is not passed through the 21° C. water bath before entering the crimper. The tow is crimped to 10 crimps per inch before dyeing.

The examples are summarized in Table I. When the fibers of Example 3 are dried before dyeing a K/S value of 3.9 or less is obtained.

The addition of sodium sulfate to the dye bath of Example 1 at a rate of 25 grams per liter of bath, and the addition or a steaming step of the dyed sample at 30 psig for 30 minutes before scouring increases the dye pick-up and retention so that smaller amounts of dye yield the same K/S values as in Example 1.

Table I

| | | | Crimped Fiber | |
|---|---|---|---|---|
| Example | Pre-crimp treatment | Post-crimp treatment | Moisture before dyeing, % | Dyed K/S |
| 1 | water bath | none | 15 | 6.0 |
| 2 | water bath | water spray | 42 | 6.9 |
| 3 | water soaked | water spray | 32 | 8.3 |
| 4 | none | none | 8–10 | 3.9 |

What is claimed is:

1. An improved process for dyeing high strength, high modulus aromatic polyamide fibers comprising the steps of (1) wetting the dry fibers to contain at least 15% by weight moisture, (2) crimping the fibers while wet to at least 10 crimps per inch (3.9/cm.), (3) maintaining the crimped fibers so that they contain at least 15% by weight moisture based on the dry fibers at all times before dyeing and (4) dyeing the fibers.

2. Process of claim 1 wherein the crimped fibers are dyed with cationic dyes.

3. Process of claim 1 wherein additional water is added after crimping so as to maintain at least 30% by weight moisture in the crimped fibers at all times before dyeing.

4. Process of claim 2 wherein the fibers are crimped to at least 12 crimps per inch (4.7/cm.).

5. Process of claim 2 wherein the crimped fibers are dyed under pressure.

6. Process of claim 1 wherein the fibers are crimped in a steam stuffer-box crimper.

* * * * *